US007318871B2

(12) United States Patent
Egan et al.

(10) Patent No.: US 7,318,871 B2
(45) Date of Patent: Jan. 15, 2008

(54) VEHICULAR CLEANING CONCENTRATE

(75) Inventors: Veronica M. Egan, Pleasanton, CA (US); Ashot K. Serobian, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 363 days.

(21) Appl. No.: 10/870,248

(22) Filed: Jun. 16, 2004

(65) Prior Publication Data

US 2005/0282719 A1 Dec. 22, 2005

(51) Int. Cl.

| | |
|---|---|
| ***B08B 3/02*** | (2006.01) |
| ***B08B 3/04*** | (2006.01) |
| ***C11D 1/00*** | (2006.01) |
| ***C11D 3/37*** | (2006.01) |
| ***C11D 3/43*** | (2006.01) |

(52) U.S. Cl. ..... 134/42; 134/39; 134/40; 510/189; 510/243; 510/245; 510/405; 510/535

(58) Field of Classification Search ..... 510/189, 510/243, 245, 405, 535; 134/39, 40, 42
See application file for complete search history.

(56) References Cited

U.S. PATENT DOCUMENTS

| | | | | |
|---|---|---|---|---|
| 5,516,459 | A * | 5/1996 | Van Eenam | 510/365 |
| 5,534,199 | A | 7/1996 | Winkler | 510/242 |
| 5,759,980 | A | 6/1998 | Russo et al. | 510/241 |
| 5,932,023 | A | 8/1999 | Ward et al. | 134/3 |
| 6,339,054 | B1 | 1/2002 | Levitt et al. | 510/241 |
| 6,350,725 | B1 * | 2/2002 | Levitt et al. | 510/189 |
| 6,506,715 | B1 | 1/2003 | Schultz et al. | 510/189 |
| 6,562,142 | B2 * | 5/2003 | Barger et al. | 134/6 |
| 6,602,350 | B2 | 8/2003 | Levitt et al. | 134/26 |
| 6,903,062 | B2 * | 6/2005 | Griese et al. | 510/405 |
| 2002/0160924 | A1 | 10/2002 | Bertrem et al. | 510/189 |
| 2002/0173438 | A1 | 11/2002 | Levitt et al. | 510/189 |

FOREIGN PATENT DOCUMENTS

| | | |
|---|---|---|
| WO | WO/0071655 | 11/2000 |

* cited by examiner

*Primary Examiner*—Brian Mruk
(74) *Attorney, Agent, or Firm*—Erin Collins

(57) ABSTRACT

The present invention relates generally to compositions, methods of use and kits for vehicular cleaning employing a cleaning concentrate containing at least one surfactant and at least one rheology modifier, optionally a solvent and/or optionally an alkalinity source, that exhibits a Vertical Cling parameter of between 1 and about 7 at a temperature of about 25° C. on soiled surfaces to which the compositions are applied.

19 Claims, No Drawings

VEHICULAR CLEANING CONCENTRATE

BACKGROUND OF THE INVENTION

1. Field of the Invention

The present invention relates generally to compositions, methods of use and kits for vehicular cleaning employing a cleaning concentrate exhibiting selective Vertical Cling. The present invention also relates to a cleaning concentrate containing at least one surfactant and a rheology modifier, and optionally a solvent and/or an alkalinity source, that exhibits a Vertical Cling parameter of between 1 and about 7 at a temperature of about 25° C. The present invention also relates to a method of cleaning an exterior surface by applying the inventive cleaning concentrate directly to a soiled surface, followed by spreading the inventive compositions to act on the soil, and then rinsing the compositions and soil away with water. The present invention further relates to a vehicular cleaning kit employing the cleaning concentrate, a dispensing package and instructions for applying the concentrate directly onto a soiled surface. Most particularly, the present invention relates to a vehicular cleaning kit which employs a deformable container with an elastomeric nozzle that enables application of the cleaning concentrate by hand directly to an exterior vehicular surface or cleaning implement, where the cleaning concentrate exhibits a Vertical Cling parameter of between 1 and about 7 at a temperature of about 25° C.

2. Description of the Related Art

A typical approach in the art for cleaning a vehicle, such as for an example an automobile or boat, is to employ a bucket of water and a cleaning concentrate such as a dish soap or liquid detergent that is added to the water and mixed to make a dilute cleaning solution. This cleaning solution is then used with a suitably absorbent material, such as a sponge, towel or shami, to apply the cleaning solution to the surface to effect removal of deposited stains, soils and dirt. This approach has some drawbacks, particularly in that the cleaning solution readily runs off the vehicle surfaces and mostly ends up on the ground. Use of a cleaning solution in a bucket also results in a concentration of dirt and soil owing to the repeated wringing and dipping of the absorbent material in order to get a "fresh" aliquot of cleaning solution. Thus, the cleaning solution becomes increasing soiled and dirt laden, resulting in decreased cleaning efficiency as well as increased tendency for the concentrated dirt to be taken up by the absorbent article and transferred back onto the vehicular surface, resulting in poorer cleaning or even of greater concern, increased tendency to scratch or abrade the treated surfaces.

Some art has attempted to overcome these deficiencies, such as for example including dirt precipitating polymers to quickly settle soils within a cleaning solution. A preponderance of art exists for tools that deliver diluted cleaning solution directly to the vehicle surface, or to an absorbent cleaning head on the tool in contact with the vehicle surface, some employing fresh water source from a garden hose, for example. Despite the improvement to the cleaning process, however, these approaches do not address the fundamental deficiency of a cleaning approach whereby a dilute cleaning solution is delivered to the soiled surface. In addition to requiring the use of a bucket or specialty tool, the previous approaches necessitate dilution of the cleaning concentrate before application, and respective dilution of all the performance enabling components of the cleaning composition before application.

Most desirably, a cleaning concentrate would be best employed by applying the cleaning concentrate directly to the soiled vehicular surface so that its respective performance enabling components could act directly on the soils and surfaces. However, cleaning concentrates in the current art are intended for dilution and ease of dissolution in water to prepare a dilute cleaning solutions, and no teachings for direct application to vehicular surfaces are provided. In fact, cleaning concentrates common in the art are not suitable for direct application to vehicular surfaces as they also suffer from the same deficiency as the diluted cleaning solutions and quickly flow and run-off from surfaces, particularly vertical surfaces and wet surfaces.

Accordingly, there is a need in the art for improved compositions and methods which will provide easier and improved cleaning of vehicular surfaces without requiring dilution or use of diluted cleaning solutions necessitating use of a bucket or specialized cleaning tool and the deficiencies inherent in such use.

SUMMARY OF THE INVENTION

In accordance with the above objects and those that will be mentioned and will become apparent below, one aspect of the present invention is a cleaning concentrate containing at least one surfactant and a rheology modifier that exhibits a Vertical Cling parameter of between 1 and about 7 at a temperature of about 25° C. In one embodiment of the present invention, the inventive cleaning concentrate adheres to a wetted vertical surface of an automobile without running, dripping or flowing excessively as measured by the Vertical Cling parameter.

In another embodiment of the present invention is a cleaning concentrate containing at least one surfactant and a rheology modifier that exhibits a Vertical Cling parameter of between 1 and about 7 at a temperature of about 25° C., and optionally containing a solvent, and optionally containing an alkalinity source.

In yet another embodiment of the present invention is a cleaning concentrate containing at least one surfactant, at least one solvent and a rheology modifier that exhibits a Vertical Cling parameter of between 1 and about 7 at a temperature of about 25° C., and optionally containing an alkalinity source.

In yet one further embodiment of the present invention is a cleaning concentrate containing at least one surfactant and a rheology modifier that exhibits a Vertical Cling parameter of between 1 and about 7 at a temperature of about 25° C., and optionally other adjuncts that provide at least one additional aesthetic, cleaning and/or protecting benefit to the inventive compositions.

In another embodiment of the present invention is a method of cleaning an exterior surface by applying the inventive cleaning concentrate that exhibits a Vertical Cling parameter of between 1 and about 7 at a temperature of about 25° C. directly to a soiled surface, followed by spreading the inventive compositions to act on the soil, and then rinsing the compositions and soil away with water. In a further embodiment of the present invention is a method of applying additional cleaning concentrate to a portion of the soiled surface following an initial cleaning and/or rinsing step to effect further cleaning. In this embodiment of the present invention, just the right amount of the inventive cleaning concentrate is used to clean the entirety of a soiled surface without wasting any material.

In one further embodiment of the present invention is a vehicular cleaning kit employing the inventive cleaning concentrate, a dispensing package and instructions for applying the concentrate directly onto a soiled surface. In one aspect of this embodiment of the present invention is a vehicular cleaning kit which employs a deformable container with an elastomeric nozzle that enables application of the cleaning concentrate by hand to an exterior vehicular surface, where the cleaning concentrate exhibits a Vertical Cling parameter of between 1 and about 7 at a temperature of about 25° C.

In yet a further embodiment of the present invention is a method for cleaning a soiled surface comprising the steps of (a) applying to the soiled surface a cleaning concentrate having a Vertical Cling parameter of between 1 and about 7 at a temperature of about 25° C., wherein the cleaning concentrate contains (i) a surfactant; (ii) optionally, a solvent; (iii) optionally, an alkalinity source; and (iv) a rheology modifier; (b) spreading the cleaning concentrate across the soiled surface to act on the soil; and (c) rinsing the surface with water to remove both the cleaning concentrate and the soil.

In an embodiment of the present invention, the vehicular cleaning kit instructions include step wise directions for a method of use whereby the inventive compositions are applied directing onto a soiled surface, followed by a cleaning step wherein the concentrated cleaner is spread across the surface to act on soil, followed by a rinsing step with water to remove the cleaning concentrate and soil.

In yet other embodiment of the present invention, the vehicular cleaning kit instructions include directions for using a cleaning concentrate containing a surfactant and a rheology modifier such that the cleaning concentrate exhibits a Vertical Cling parameter of between 1 and about 7 at a temperature of about 25° C. in combination with a dispensing package bearing instructions for application of the cleaning concentrate to a surface. In one aspect of this embodiment, the cleaning concentrate is applied directly to a soiled surface. In another aspect of this embodiment, the cleaning concentrate is first applied to an absorbent article, such as for example a sponge or towel, which is then employed to directly apply the cleaning concentrate to a soiled surface.

In one related embodiment of the present invention, simple hand pressure applied by squeezing a deformable container with an elastomeric nozzle and containing the inventive composition is sufficient to dispense the composition in the form of a liquid stream emanating from the elastomeric nozzle of the container and impinging onto the soiled surface where the inventive composition adheres with sufficient cling to resist running, dripping or flowing excessively as measured by the Vertical Cling parameter.

Further features and advantages of the present invention will become apparent to those of ordinary skill in the art in view of the detailed description of suitable embodiments below, when considered together with the attached claims.

DETAILED DESCRIPTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined-otherwise, all technical and scientific terms used herein have the same meaning as commonly understood by one of ordinary skill in the art to which the invention pertains. Although a number of methods and materials similar or equivalent to those described herein can be used in the practice of the present invention, exemplary materials and methods are described herein.

In the application, effective amounts are generally those amounts listed as the ranges or levels of ingredients in the descriptions, which follow hereto. Unless otherwise stated, amounts listed in percentage ("%'s") are in weight percent of the total composition. Compositions are generally expressed in weight percent equivalent to 100% active material (active weight basis) and thus carrier or solvent weight is not included in the expressed percentage.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The term "cleaning composition", as used herein, is meant to mean and include a formulation having at least one surfactant or at least one solvent.

The term "cleaning concentrate", as used herein, is meant to mean and include a formulation having at least one surfactant or at least one solvent, wherein said at least one surfactant or at least one solvent is individually present at a level of at least 1 weight percent (wt %) of the total cleaning concentrate weight.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, cationic, nonionic, zwitterionic and/or amphoteric agents.

The terms "viscosity", as used herein is the viscosity of a liquid component of the invention as quoted as a kinematic viscosity in centipoise (cps), measured at 25° C. (77° F.), unless otherwise specified.

Composition

The inventive compositions comprise combinations of a surfactant and a rheology modifier, optionally a solvent, and/or optionally an alkalinity source, that are combined to provide a concentrated cleaning composition having a suitable substantivity to a vertical surface, defined by a Vertical Cling parameter, such that when applied to a soiled vertical surface, the inventive compositions do not run, drip or flow excessively from the point of application. The inventive compositions contain at least one surfactant to provide cleaning performance and contain at least one rheology modifier that contributes to thickening and the desirable rheological properties that provide the compositions with a Vertical Cling parameter of between 1 and about 7 at a temperature of about 25° C.

Surfactant

The inventive compositions contain at least one surfactant. The inventive compositions may contain one or more surfactants selected from anionic, nonionic, cationic, ampholytic, amphoteric and zwitterionic surfactants and mixtures thereof. A typical listing of anionic, nonionic, ampholytic, and zwitterionic classes, and species of these surfactants, is given in U.S. Pat. No. 3,929,678 to Laughlin and Heuring, which is hereby incorporated by reference. A list of suitable cationic surfactants is given in U.S. Pat. No. 4,259,217 to Murphy, which is hereby incorporated by reference. Where present, ampholytic, amphoteric and zwitterionic surfactants are generally used in combination with one or more anionic and/or nonionic surfactants.

The composition may comprise an anionic surfactant. Essentially any anionic surfactants useful for detersive purposes can be comprised in the inventive composition. These can include salts (including, for example, sodium, potassium, ammonium, and substituted ammonium salts such as mono-, di- and tri-ethanolamine salts) of the anionic sulfate, sulfonate, carboxylate and sarcosinate surfactants. Anionic surfactants may comprise a sulfonate or a sulfate surfactant. Anionic surfactants may comprise an alkyl sulfate, a linear or branched alkyl benzene sulfonate, or an alkyldiphenyloxide disulfonate, as described herein.

Other anionic surfactants include the isethionates such as the acyl isethionates, N-acyl taurates, fatty acid amides of methyl tauride, alkyl succinates and sulfosuccinates, monoesters of sulfosuccinate (for instance, saturated and unsaturated C12-C18 monoesters) diesters of sulfosuccinate (for instance saturated and unsaturated C6-C14 diesters), N-acyl sarcosinates. Resin acids and hydrogenated resin acids are also suitable, such as rosin, hydrogenated rosin, and resin acids and hydrogenated resin acids present in or derived from tallow oil. Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the C5-C17acyl-N—(C1-C4 alkyl) and —N—(C1-C2 hydroxyalkyl) glucamine sulfates, and sulfates of alkylpolysaccharides such as the sulfates of alkylpolyglucoside (the nonionic non-sulfated compounds being described herein). Alkyl sulfate surfactants may be selected from the linear and branched primary C10-C18 alkyl sulfates, the C11-C15 branched chain alkyl sulfates, or the C12-C 14 linear chain alkyl sulfates.

Alkyl ethoxysulfate surfactants may be selected from the group consisting of the C10-C18 alkyl sulfates which have been ethoxylated with from 0.5 to 20 moles of ethylene oxide per molecule. The alkyl ethoxysulfate surfactant may be a C11-C18, or a C11-C15 alkyl sulfate which has been ethoxylated with from 0.5 to 7, or from 1 to 5, moles of ethylene oxide per molecule. One aspect of the invention employs mixtures of the alkyl sulfate and/ or sulfonate and alkyl ethoxysulfate surfactants. Such mixtures have been disclosed in PCT patent application No. WO 93/18124, which is hereby incorporated by reference.

Anionic sulfonate surfactants suitable for use herein include the salts of C5-C20 linear alkylbenzene sulfonates, alkyl ester sulfonates, C6-C22 primary or secondary alkane sulfonates, C6-C24 olefin sulfonates, sulfonated polycarboxylic acids, alkyl glycerol sulfonates, fatty acyl glycerol sulfonates, fatty oleoyl glycerol sulfonates, and any mixtures thereof. Suitable anionic carboxylate surfactants include the alkyl ethoxy carboxylates, the alkyl polyethoxy polycarboxylate surfactants and the soaps ('alkyl carboxyl's'), especially certain secondary soaps as described herein. Suitable alkyl ethoxy carboxylates include those with the formula $RO(CH_2CH_2O)_xCH_2COO^-M^+$ wherein R is a C6 to C18 alkyl group, x ranges from 0 to 10, and the ethoxylate distribution is such that, on a weight basis, the amount of material where x is 0 is less than 20% and M is a cation. Suitable alkyl polyethoxypolycarboxylate surfactants include those having the formula $RO—(CHR^1—CHR^2—O)—R^3$ wherein R is a C6 to C18 alkyl group, x is from 1 to 25, $R^1$ and $R^2$ are selected from the group consisting of hydrogen, methyl acid radical, succinic acid radical, hydroxysuccinic acid radical, and mixtures thereof, and $R^3$ is selected from the group consisting of hydrogen, substituted or unsubstituted hydrocarbon having between 1 and 8 carbon atoms, and mixtures thereof.

Suitable soap surfactants include the secondary soap surfactants, which contain a carboxyl unit connected to a secondary carbon. Suitable secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Other suitable anionic surfactants are the alkali metal sarcosinates of formula $R—CON\ (R^1)CH—)COOM$, wherein R is a C5-C17 linear or branched alkyl or alkenyl group, $R^1$ is a C1-C4 alkyl group and M is an alkali metal ion. Examples are the myristyl and oleoyl methyl sarcosinates in the form of their sodium salts.

Essentially any alkoxylated nonionic surfactants are suitable herein, for instance, ethoxylated and propoxylated nonionic surfactants. Alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ ethylene diamine adducts.

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Also suitable are the condensation products of alcohols having an alkyl group containing from 8 to 20 carbon atoms with from 2 to 10 moles of ethylene oxide per mole of alcohol.

Polyhydroxy fatty acid amides suitable for use herein are those having the structural formula $R^2CONR^1Z$ wherein: $R^1$ is H, C1-C4 hydrocarbyl, 2-hydroxyethyl, 2-hydroxypropyl, ethoxy, propoxy, or a mixture thereof, for instance, C1-C4 alkyl, or C1 or C2 alkyl; and $R^2$ is a C5-C3 1 hydrocarbyl, for instance, straight-chain C5-C19 alkyl or alkenyl, or straight-chain C9-C17 alkyl or alkenyl, or straight-chain C 11-C17 alkyl or alkenyl, or mixture thereof-, and Z is a polyhydroxyhydrocarbyl having a linear hydrocarbyl chain with at least 3 hydroxyls directly connected to the chain, or an alkoxylated derivative (for example, ethoxylated or propoxylated) thereof. Z may be derived from a reducing sugar in a reductive amination reaction, for example, Z is a glycidyl.

Suitable fatty acid amide surfactants include those having the formula: $R^1CON(R^2)_2$ wherein $R^1$ is an alkyl group containing from 7 to 21, or from 9 to 17 carbon atoms and each R is selected from the group consisting of hydrogen, C1-C4 alkyl, C1-C4 hydroxyalkyl, and —$(C_2H_4O)_xH$, where x is in the range of from 1 to 3.

Suitable alkylpolysaccharides for use herein are disclosed in U.S. Pat. No. 4,565,647 to Llenado, having a hydrophobic group containing from 6 to 30 carbon atoms and a polysaccharide, e.g., a polyglycoside, hydrophilic group containing from 1.3 to 10 saccharide units. Alkylpolyglycosides may have the formula: $R^2O(C_nH_{2n}O)_t(\text{glycosyl})_x$ wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl may be derived from glucose.

Suitable amphoteric surfactants for use herein include the amine oxide surfactants and the alkyl amphocarboxylic acids. Suitable amine oxides include those compounds having the formula $R^3(OR^4)_xNO(R^5)_2$ wherein $R^3$ is selected from an alkyl, hydroxyalkyl, acylamidopropyl and alkylphenyl group, or mixtures thereof, containing from 8 to 26 carbon atoms; $R^4$ is an alkylene or hydroxyalkylene group containing from 2 to 3 carbon atoms, or mixtures thereof, x is from 0 to 5, alternatively from 0 to 3; and each $R^5$ is an alkyl or hydroxyalkyl group containing from 1 to 3, or a polyethylene oxide group containing from 1 to 3 ethylene oxide groups. Suitable amine oxides are C10-C18 alkyl dimethylamine oxide, and C10-18 acylamido alkyl dimethylamine oxide. A suitable example of an alkyl amphodicarboxylic acid is Miranol(™) C2M Conc. manufactured by Miranol, Inc., Dayton, N.J.

Zwitterionic surfactants can also be incorporated into the inventive compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R^1)_2N^+R^2COO^-$ wherein R is a C6-C18 hydrocarbyl group, each $R^1$ is typically C1-C3 alkyl, and $R^2$ is a C1-C5 hydrocarbyl group. Suitable betaines are C12-18 dimethylammonium hexanoate and the C10-18 acylamidopropane (or ethane) dimethyl (or diethyl) betaines. Complex betaine surfactants are also suitable for use herein.

Suitable cationic surfactants to be used herein include the quaternary ammonium surfactants. The quaternary ammonium surfactant may be a mono C6-C16, or a C6-C10 N-alkyl or alkenyl ammonium surfactant wherein the remaining N positions are substituted by methyl, hydroxyethyl or hydroxypropyl groups. Suitable are also the mono-alkoxylated and bis-alkoxylated amine surfactants.

Another suitable group of cationic surfactants, which can be used in the inventive compositions, are cationic ester surfactants. The cationic ester surfactant is a compound having surfactant properties comprising at least one ester (i.e. —COO—) linkage and at least one cationically charged group. Suitable cationic ester surfactants, including choline ester surfactants, have for example been disclosed in U.S. Pat. Nos. 4,228,042, 4,239,660 and 4,260,529, which are all hereby incorporated by reference. The ester linkage and cationically charged group may be separated from each other in the surfactant molecule by a spacer group consisting of a chain comprising at least three atoms (i.e. of three atoms chain length), or from three to eight atoms, or from three to five atoms, or three atoms. The atoms forming the spacer group chain are selected from the group consisting, of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—, $CH_2$— and —$CH_2$—NH—$CH_2$— linkages are included. The spacer group chain may comprise only carbon atoms, or the chain is a hydrocarbyl chain.

The inventive composition may comprise cationic mono-alkoxylated amine surfactants, for instance, of the general formula: $R^1R^2R^3N^+ApR^4X^-$ wherein $R^1$ is an alkyl or alkenyl moiety containing from about 6 to about 18 carbon atoms, or from 6 to about 16 carbon atoms, or from about 6 to about 14 carbon atoms; $R^2$ and $R^3$ are each independently alkyl groups containing from one to about three carbon atoms, for instance, methyl, for instance, both $R^2$ and $R^3$ are methyl groups; $R^4$ is selected from hydrogen, methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, or from 2 to about 15, or from 2 to about 8. The $ApR^4$ group in the formula may have p=1 and is a hydroxyalkyl group, having no greater than 6 carbon atoms whereby the —OH group is separated from the quaternary ammonium nitrogen atom by no more than 3 carbon atoms. Suitable $ApR^4$ groups are —$CH_2CH_2$—OH, —$CH_2CH_2CH_2$—OH, —$CH_2CH(CH_3)$—OH and —$CH(CH_3)CH_2$—OH. Suitable $R^1$ groups are linear alkyl groups, for instance, linear $R^1$ groups having from 8 to 14 carbon atoms.

Suitable cationic mono-alkoxylated amine surfactants for use herein are of the formula $R^1(CH_3)(CH_3)N^+(CH_2CH_2O)_{2\text{-}5}H\ X^-$ wherein $R^1$ is C10-C18 hydrocarbyl and mixtures thereof, especially C10-C14 alkyl, or C10 and C12 alkyl, and X is any convenient anion to provide charge balance, for instance, chloride or bromide. As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3)O$] units (i-Pr) or n-propoxy units (Pr), or mixtures of EO and/or Pr and/or i-Pr units.

The cationic bis-alkoxylated amine surfactant may have the general formula: $R^1R^2N^+ApR^3A'qR^4X^-$ wherein $R^1$ is an alkyl or alkenyl moiety containing from about 8 to about 18 carbon atoms, or from 10 to about 16 carbon atoms, or from about 10 to about 14 carbon atoms; $R^2$ is an alkyl group containing from one to three carbon atoms, for instance, methyl; $R^3$ and $R^4$ can vary independently and are selected from hydrogen, methyl and ethyl, $X^-$ is an anion such as chloride, bromide, methylsulfate, sulfate, or the like, sufficient to provide electrical neutrality. A and A' can vary independently and are each selected from C1-C4 alkoxy, for instance, ethoxy, (i.e., —$CH_2CH_2O$—), propoxy, butoxy and mixtures thereof, p is from 1 to about 30, or from 1 to about 4 and q is from 1 to about 30, or from 1 to about 4, or both p and q are 1.

Suitable cationic bis-alkoxylated amine surfactants for use herein are of the formula $R^1CH_3N^+(CH_2CH_2OH)(CH_2CH_2OH)\ X^-$, wherein $R^1$ is C10-C18 hydrocarbyl and mixtures thereof, or C10, C12, C14 alkyl and mixtures thereof, $X^-$ is any convenient anion to provide charge balance, for example, chloride. With reference to the general cationic bis-alkoxylated amine structure noted above, since in one example compound $R^1$ is derived from (coconut)

C12-C14 alkyl fraction fatty acids, $R^2$ is methyl and $ApR^3$ and $A'qR^4$ are each monoethoxy.

Other cationic bis-alkoxylated amine surfactants useful herein include compounds of the formula: $R^1R^2N^+$—$(CH_2CH_2O)_pH$—$(CH_2CH_2O)_qH$ $X^-$ wherein $R^1$ is C10-C18 hydrocarbyl, or C10-C14 alkyl, independently p is 1 to about 3 and q is 1 to about 3, $R^2$ is C1-C3 alkyl, for example, methyl, and $X^-$ is an anion, for example, chloride or bromide. Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3)O$] units (i-Pr) or n-propoxy units (Pr), or mixtures of EO and/or Pr and/or i-Pr units.

The inventive compositions may include a fluorosurfactant selected from nonionic fluorosurfactants, cationic fluorosurfactants, and mixtures thereof which are soluble or dispersible in the aqueous compositions being taught herein, sometimes compositions which do not include further detersive surfactants, or further organic solvents, or both. Suitable nonionic fluorosurfactant compounds are found among the materials presently commercially marketed under the trade name Fluorad® (ex. 3M Corp.) Exemplary fluorosurfactants include those sold as Fluorad® FC-740, generally described to be fluorinated alkyl esters; Fluorad® FC-430, generally described to be fluorinated alkyl esters; Fluorad® FC-431, generally described to be fluorinated alkyl esters; and, Fluorad® FC-170-C, which is generally described as being fluorinated alkyl polyoxyethylene ethanols.

Suitable nonionic fluorosurfactant compounds include those which is believed to conform to the following formulation: $C_nF_{2n+1}SO_2N(C_2H_5)(CH_2CH_2O)_xCH_3$ wherein: n has a value of from 1-12, or from 4-12, or 8; x has a value of from 4-18, or from 4-10, or 7; which is described to be a nonionic fluorinated alkyl alkoxylate and which is sold as Fluorad® FC-171 (ex. 3M Corp., formerly Minnesota Mining and Manufacturing Co.).

Additionally suitable nonionic fluorosurfactant compounds are also found among the materials marketed under the trade name ZONYL® (DuPont Performance Chemicals). These include, for example, ZONYL® FSO and ZONYL® FSN. These compounds have the following formula: $RfCH_2CH_2O(CH_2CH_2O)_xH$ where Rf is $CF_3(CF_2CF_2)_y$. For ZONYL® FSO, x is 0 to about 15 and y is 1 to about 7. For ZONYL® FSN, x is 0 to about 25 and y is 1 to about 9.

An example of a suitable cationic fluorosurfactant compound has the following structure: $CnF_{2n+1}SO_2NHC_3H_6N^+(CH_3)_3I^-$ where n~8. This cationic fluorosurfactant is available under the trade name Fluorad® FC-135 from 3M. Another example of a suitable cationic fluorosurfactant is $CF_3$—$(CF_2)_n$—$(CH_2)_mSCH_2CHOH$—$CH_2$—$N^+R_1R_2R_3Cl^-$ wherein: n is 5-9 and m is 2, and $R_1$, $R_2$ and $R_3$ are —$CH_3$. This cationic fluorosurfactant is available under the trade name ZONYL® FSD (available from DuPont, described as 2-hydroxy-3-((gamma-omega-perfluoro-$C_{6-20}$-alkyl)thio)-N,N,N-trimethyl-1-propyl ammonium chloride). Other cationic fluorosurfactants suitable for use in the present invention are also described in EP 866,115 to Leach and Niwata, which is hereby incorporated by reference.

The surfactant may be present in the compositions of the present invention at a level of from about 0.001% to 90%, or from about 0.01% to 75%, or from about 0.1% to 50% by weight.

Rheology Modifier

The inventive compositions contain at least one rheology modifier that contributes to both thickening and the rheological structure of the cleaning concentrate and contributes to the desirable vertical clinging characteristics of the present invention. The at least one rheology modifier may be selected from the group consisting of organic polymers, natural polymers, inorganic thickeners, and their derivatives. Mixtures of the rheology modifiers may also be suitably employed.

In general, any suitable organic polymer may be employed as a rheology modifier, such organic polymer generally referring to the class of synthetic or man-made polymers. The inventive compositions may employ water-soluble or water dispersible polymers. The inventive compositions may employ nonionic (neutral and/or non-ionizable), anionic and/or cationic polymers, and their mixtures. Suitable anionic polymers include those with ionizable groups that are at least partially anionic in solution, that is carrying a negative charge in solution, or which can be at least partially or fully neutralized to be at least partially or fully anionic in solution. Suitable cationic polymers include polymers that are ionizable (i.e. capable of being protonated) and those with permanent cationic groups, that is carrying a permanent positive charge, in solution. The inventive compositions may employ hydrophilic polymers, hydrophobic polymers or polymers exhibiting both properties owing to the presence of hydrophilic and hydrophobic monomer moieties. Suitable hydrophilic polymers are those that are attracted to surfaces and are absorbed thereto without covalent bonds. Examples of suitable polymers include the polymers and co-polymers of N,N-dialkyl acrylamide, acrylamide, and certain monomers containing substituted and/or unsubstituted quaternary ammonium groups and/or amphoteric groups that favor substantivity to surfaces, along with co-monomers that favor adsorption of water, such as, for example, acrylic acid and other acrylate salts, sulfonates, betaines, and ethylene oxides. Water soluble or water dispersible cationic polymers may be suitable for their charge dissipative effect, antistatic, surface lubricating and potential softening benefits.

With respect to the synthesis of a water soluble or water dispersible cationic copolymer, the level of the first monomer, which has a permanent cationic charge or that is capable of forming a cationic charge on protonation, is typically between 3 and 80 mol % or alternatively between 10 to 60 mol % of the copolymer. The level of second monomer, which is an acidic monomer that is capable of forming an anionic charge in the composition, when present is typically between 3 and 80 mol % or alternatively between 10 to 60 mol % of the copolymer. The level of the third monomer, which has an uncharged hydrophilic group, when present is typically between 3 and 80 mol % or alternatively between 10 to 60 mol % of the copolymer. When present, the level of uncharged hydrophobic monomer is less than about 50 mol % or alternatively less than 10 mol % of the copolymer. The molar ratio of the first monomer to the second monomer typically ranges from 19:1 to 1:1 or alternatively ranges from 9:1 to 1:6. The molar ratio of the first monomer to the third monomer is typically ranges from 4:1 to 1:4 or alternatively ranges from 2:1 to 1:2.

The average molecular weight of the copolymer typically ranges from about 5,000 to about 10,000,000, with the suitable molecular weight range depending on the polymer composition with the proviso that the molecular weight is selected so that the copolymer is water soluble or water dispersible to at least 0.01% by weight in distilled water at 25° C.

Examples of permanently cationic monomers include, but are not limited to, quaternary ammonium salts of substituted acrylamide, methacrylamide, acrylate and methacrylate, such as trimethylammoniumethylmethacrylate, trimethylammoniumpropylmethacrylamide, trimethylammoniumethylmethacrylate, trimethylammoniumpropylacrylamide, 2-vinyl N-alkyl quaternary pyridinium, 4-vinyl N-alkyl quaternary pyridinium, 4-vinylbenzyltrialkylammonium, 2-vinyl piperidinium, 4-vinyl piperidinium, 3-alkyl 1-vinyl imidazolium, diallyldimethylammonium, and the ionene class of internal cationic monomers as described by D. R. Berger in *Cationic Surfactants, Organic Chemistry*, edited by J. M. Richmond, Marcel Dekker, New York, 1990, ISBN 0-8247-8381-6, which is incorporated herein by reference. This class includes co-poly ethylene imine, co-poly ethoxylated ethylene imine and co-poly quaternized ethoxylated ethylene imine, co-poly[(dimethylimino)trimethylene(dimethylimino)hexamethylene disalt], co-poly[(diethylimino)trimethylene(dimethylimino)trimethylene disalt], co-poly [(dimethylimino)2-hydroxypropyl salt], co-polyquarternium-2, co-polyquarternium-17, and co-polyquarternium-18, as described in the *International Cosmetic Ingredient Dictionary,* 5th Edition, edited by J. A. Wenninger and G. N. McEwen, which is incorporated herein by reference. Other cationic monomers include those containing cationic sulfonium salts such as co-poly-1-[3-methyl-4-(vinyl-benzyloxy)phenyl]tetrahydrothiophenium chloride. Especially suitable monomers are mono- and di-quaternary derivatives of methacrylamide. The counterion of the cationic co-monomer can be selected from, for example, chloride, bromide, iodide, hydroxide, phosphate, sulfate, hydrosulfate, ethyl sulfate, methyl sulfate, formate, and acetate.

Examples of monomers that are cationic on protonation include, but are not limited to, acrylamide, N,N-dimethylacrylamide, N,N di-isopropylacryalmide, N-vinylimidazole, N-vinylpyrrolidone, ethyleneimine, dimethylaminohydroxypropyl diethylenetriamine, dimethylaminoethylmethacrylate, dimethylaminopropylmethacrylamide, dimethylaminoethylacrylate, dimethylaminopropylacrylamide, 2-vinyl pyridine, 4-vinyl pyridine, 2-vinyl piperidine, 4-vinylpiperidine, vinyl amine, diallylamine, methyldiallylamine, vinyl oxazolidone; vinyl methyoxazolidone, and vinyl caprolactam.

Monomers that are cationic on protonation typically contain a positive charge over a portion of the pH range of 2-11. Such suitable monomers are also presented in *Water-Soluble Synthetic Polymers: Properties and Behavior*, Volume II, by P. Molyneux, CRC Press, Boca Raton, 1983, ISBN 0-8493-6136. Additional monomers can be found in the *International Cosmetic Ingredient Dictionary,* 5th Edition, edited by J. A. Wenninger and G. N. McEwen, The Cosmetic, Toiletry, and Fragrance Association, Washington D.C., 1993, ISBN 1-882621-06-9. A third source of such monomers can be found in *Encyclopedia of Polymers and Thickeners for Cosmetics*, by R. Y. Lochhead and W. R. Fron, Cosmetics & Toiletries, vol. 108, May 1993, pp 95-135. All three references are incorporated herein.

Examples of acidic monomers that are capable of forming an anionic charge in the composition include, but are not limited to, acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, citraconic acid, vinylbenzoic acid, N-vinylsuccinamidic acid, mesaconic acid, methacroylalanine, acryloylhydroxyglycine, sulfoethyl methacrylate, sulfopropyl acrylate, and sulfoethyl acrylate. Exemplary acid monomers also include styrenesulfonic acid, 2-methacryloyloxymethane-1-sulfonic acid, 3-methacryloyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid and vinyl phosphoric acid. Suitable monomers include acrylic acid, methacrylic acid and maleic acid. The copolymers useful in this invention may contain the above acidic monomers and the alkali metal, alkaline earth metal, and ammonium salts thereof.

Examples of monomers having an uncharged hydrophilic group include but are not limited to vinyl alcohol, vinyl acetate, vinyl methyl ether, vinyl ethyl ether, ethylene oxide and propylene oxide. Also suitable are hydrophilic esters of monomers, such as hydroxyalkyl acrylate esters, alcohol ethoxylate esters, alkylpolyglycoside esters, and polyethylene glycol esters of acrylic and methacrylic acid.

Finally, examples of uncharged hydrophobic monomers include, but are not limited to, $C_1$-$C_4$ alkyl esters of acrylic acid and of methacrylic acid.

Suitable copolymers are formed by copolymerizing the desired monomers. Conventional polymerization techniques can be employed. Illustrative techniques include, for example, solution, suspension, dispersion, or emulsion polymerization. An exemplary method of preparation is by precipitation or inverse suspension polymerization of the copolymer from a polymerization media in which the monomers are dispersed in a suitable solvent. The monomers employed in preparing the copolymer may be water soluble or sufficiently soluble in the polymerization media to form a homogeneous solution. They readily undergo polymerization to form polymers which are water-dispersible or water-soluble. The exemplary copolymers contain acrylamide, methacrylamide and substituted acrylamides and methacrylamides, acrylic and methacrylic acid and esters thereof. Suitable synthetic methods for these copolymers are described, for example, in Kirk-Othmer, *Encyclopedia of Chemical Technology*, Volume 1, Fourth Ed., John Wiley & Sons.

Other examples of polymers that provide sheeting and anti-spotting benefits are polymers that contain amine oxide hydrophilic groups. Polymers that contain other hydrophilic groups such a sulfonate, pyrrolidone, and/or carboxylate groups can also be used. Examples of desirable polysulfonate polymers include polyvinylsulfonate, and also include polystyrene sulfonate, such as those sold by Monomer-Polymer Dajac (1675 Bustleton Pike, Feasterville, Pa. 19053). A typical formula is as follows: $[CH(C_6H_4SO_3Na)—CH_2]_n—CH(C_6H_5)—CH_2$ wherein n is a number to give the appropriate molecular weight as disclosed below.

Typical molecular weights are from about 10,000 to about 1,000,000, or alternatively from about 200,000 to about 700,000. Exemplary polymers containing pyrrolidone functionalities include polyvinyl pyrrolidone, quaternized pyrrolidone derivatives (such as Gafquat 755N from International Specialty Products), and co-polymers containing pyrrolidone, such as polyvinylpyrrolidone/dimethylaminoethylmethacrylate (available from ISP) and polyvinyl pyrrolidone/acrylate (available from BASF). Other materials can also provide substantivity and hydrophilicity including cationic materials that also contain hydrophilic groups and polymers that contain multiple ether linkages. Cationic materials include cationic sugar and/or starch derivatives and the typical block copolymer detergent surfactants based on mixtures of polypropylene oxide and ethylene oxide are representative of the polyether materials. The polyether materials are less substantive, however.

Also suitable are polymers comprising water-soluble amine oxide moieties. It is believed that the partial positive charge of the amine oxide group can act to adhere the polymer to the surface of the surface substrate, thus allowing water to "sheet" more readily. To the extent that polymer anchoring promotes better "sheeting", then higher molecular materials are suitable. Increased molecular weight improves efficiency and effectiveness of the amine oxide-based polymer. Suitable polymers of this invention may have one or more monomeric units containing at least one N-oxide group. At least about 10%, suitably more than about 50%, more suitably greater than about 90% of said monomers forming said polymers contain an amine oxide group. These polymers can be described-by the general formula: P(B) wherein each P is selected from homopolymerizable and copolymerizable moieties which attach to form the polymer backbone, suitably vinyl moieties, e.g. C(R)2=C(R)2, wherein each R is H, C1-C12, alternatively C1-C4 alkyl (ene), C6-C12 aryl(ene) and/or B; B is a moiety selected from substituted and unsubstituted, linear and cyclic C1-C12 alkyl, C1-C12 alkylene, C1-C12 heterocyclic, aromatic C6-C12 groups and wherein at least one of said B moieties has at least one amine oxide group present; u is from a number that will provide at least about 10% monomers containing an amine oxide group to about 90%; and t is a number such that the average molecular weight of the polymer is from about 2,000 to about 500,000, alternatively from about 5,000 to about 250,000, and also alternatively from about 7,500 to about 200,000. Exemplary polymers also include poly(4-vinylpyridine N-oxide) polymers (PVNO), wherein the average molecular weight of the polymer is from about 2,000 to about 500,000, alternatively from about 5,000 to about 400,000, and also alternatively from about 7,500 to about 300,000. In general, higher molecular weight polymers are suitable. Often, higher molecular weight polymers allow for use of lower levels of the polymer, which can provide benefits in surface cleaner applications of the inventive compositions. Lower molecular weights for the exemplary poly-amine oxide polymers of the present invention are due to greater difficulty in manufacturing these polymers in higher molecular weight.

Some non-limiting examples of homopolymers and copolymers which can be used as water soluble polymers of the present invention are: adipic acid/dimethylaminohydroxypropyl diethylenetriamine copolymer; adipic acid/epoxypropyl diethylenetriamine copolymer; polyvinyl alcohol; methacryloyl ethyl betaine/methacrylates copolymer; ethyl acrylate/methyl methacrylate/methacrylic acid/acrylic acid copolymer; polyamine resins; and polyquaternary amine resins; poly(ethenylformamide); poly(vinylamine)hydrochloride; poly(vinyl alcohol-co-vinylamine); poly(vinyl alcohol-co-vinylamine); poly(vinyl alcohol-co-vinylamine hydrochloride); and poly(vinyl alcohol-co-vinylamine hydrochloride). Alternatively, said copolymer and/or homopolymers are selected from the group consisting of adipic acid/dimethylaminohydroxypropyl diethylenetriamine copolymer; poly(vinylpyrrolidone/dimethylaminoethyl methacrylate); polyvinyl alcohol; ethyl acrylate/methyl methacrylate/ethacrylic acid/acrylic acid copolymer; methacryloyl ethyl betaine/methacrylates copolymer; polyquaternary amine resins; poly(ethenylformamide); poly(vinylamine)hydrochloride; poly(vinyl alcohol-co-vinylamine); poly(vinyl alcohol-co-vinylamine); poly(vinyl alcohol-co-vinylamine hydrochloride); and poly(vinyl alcohol-co-vinylamine hydrochloride).

Polymers useful in the present invention can be selected from the group consisting of copolymers of hydrophilic monomers. The polymer can be linear random or block copolymers, and mixtures thereof. The term "hydrophilic" is used herein consistent with its standard meaning of having at least some affinity for water. As used herein in relation to monomer units and polymeric materials, including the copolymers, "hydrophilic" means substantially water soluble and/or substantially water dispersible. In this regard, "substantially water soluble" or "substantially water dispersible" shall refer to a material that is soluble and/or dispersible in distilled (or equivalent) water, at 25° C., at a concentration of about 0.0001% by weight or greater. The terms "soluble", "solubility", "dispersible", and the like, for purposes hereof, correspond to the maximum concentration of monomer or polymer, as applicable, that can dissolve or disperse in water and/or other solvents, or their mixtures, to form a homogeneous solution, as is well understood to those skilled in the art.

Nonlimiting examples of useful hydrophilic monomers are unsaturated organic mono- and polycarboxylic acids, such as acrylic acid, methacrylic acid, crotonic acid, maleic acid and its half esters, itaconic acid; unsaturated alcohols, such as vinyl alcohol, allyl alcohol; polar vinyl heterocyclics, such as, vinyl caprolactam, vinyl pyridine, vinyl imidazole; vinyl amine; vinyl sulfonate; unsaturated amides, such as acrylamides, e.g., N,N-dimethylacrylamide, N-t-butyl acrylamide; hydroxyethyl methacrylate; dimethylaminoethyl methacrylate; salts of acids and amines listed above; and the like; and mixtures thereof. Some exemplary hydrophilic monomers are acrylic acid, methacrylic acid, N,N-dimethyl acrylamide, N,N-dimethyl methacrylamide, N-t-butyl acrylamide, dimethylamino ethyl methacrylate, thereof, and mixtures thereof.

Polycarboxylate polymers are those formed by polymerization of monomers, at least some of which contain carboxylic functionality. Common monomers include acrylic acid, maleic acid, ethylene, vinyl pyrrolidone, methacrylic acid, methacryloylethylbetaine, etc. Exemplary polymers for substantivity are those having higher molecular weights. For example, polyacrylic acid having molecular weights below about 10,000 are not particularly substantive and therefore do not normally provide hydrophilicity for three rewettings of a treated surface with the inventive compositions, although with higher levels, molecular weights down to about 1000 can provide some results. In general, the polymers should have molecular weights of more than about 10,000. It has also been found that higher molecular weight polymers, e.g., those having molecular weights of more than about 10,000,000, are extremely difficult to formulate and are less effective in providing anti-spotting benefits than lower molecular weight polymers. Accordingly, the molecular weight should normally be, especially for polyacrylates, from about 1,000 to about 10,000,000; alternatively from about 5,000 to about 5,000,000; alternatively from about 10,000 to about 2,500,000; and also suitably from about 20,000 to about 1,000,000.

Non-limiting examples of polymers for use in the present invention include the following: poly(vinyl pyrrolidone/acrylic acid) sold under the name "Acrylidone"® by ISP and poly(acrylic acid) sold under the name "Accumer"® by Rohm & Haas. Other suitable materials include sulfonated polystyrene polymers sold under the name Versaflex® sold by National Starch and Chemical Company, especially Versaflex 7000.

Suitable polymers may be selected from the group consisting of water soluble and water dispersible polyacrylate polymers and copolymers containing at least one acrylate monomer, water swellable and alkali swellable polyacrylate polymers and copolymers containing at least one acrylate monomer, non-linear polyacrylate polymers cross-linked with at least one polyalkenyl polyether monomer, film-forming and water swellable non-soluble polyacrylate polymers, hydrophobically modified cross-linked polyacrylate polymers and copolymers containing at least one hydrophobic monomer, water dispersible associative and non-associative polyacrylate polymers and copolymers containing at least one acrylate monomer, and mixtures thereof. In additional suitable polymers, copolymers or derivatives thereof are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatin, natural gums such as xantham and carrageen. Exemplary polymers are also selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates. Also suitable are polymers are selected from polyvinyl alcohols, polyvinyl alcohol copolymers, hydroxypropyl methyl cellulose (HPMC), xantham gum and starch. The polymer may have any weight average molecular weight from about 1000 to 1,000,000, or even from 10,000 to 300,000 or even from 15,000 to 200,000 or even from 20,000 to 150,000.

Also useful are polymer blend compositions, for example blends comprising a hydrolytically degradable and water-soluble polymer blend such as polylactide and polyvinyl alcohol, achieved by the mixing of polylactide and polyvinyl alcohol, typically comprising 1-35% by weight polylactide and approximately from 65% to 99% by weight polyvinyl alcohol, if the material is to be water-dispersible, or water-soluble.

In general, natural polymers and derivatized natural polymers may be employed as rheology modifiers. Some non-limiting examples of natural polymers and derivatized natural polymers, suitable for use in the present invention include polysaccharide polymers, which include substituted cellulose materials like carboxymethylcellulose, ethyl cellulose, hydroxyethylcellulose, hydroxypropylcellulose, hydroxymethylcellulose, succinoglycan and naturally occurring polysaccharide polymers like xanthan gum, guar gum, locust bean gum, tragacanth gum, carrageen gum or derivatives thereof. Also suitable are polypeptides and proteins, for example, but not limited to gelatin and gelatin derivatives, peptin, peptone, and the like, as well as polysaccharide and peptide copolymers, such as peptidoglycans and the like.

Also suitable for use as rheology modifiers are inorganic thickeners, generally in the form of fine particulate additives including colloids and nanoparticulates. Examples of such inorganic thickeners include, but are not limited to materials such as natural clays, silicas, zeolites, finely divided metal oxides, finely divided inorganic minerals and nanoparticulate forms of such materials, and their mixtures. Also included are derivatized inorganic thickening agents, such as for example, fumed silica, silanized silica and hydrophobized silica, and the like. Examples of metal oxides include, but are not limited to, oxides of alkali metals, alkaline earth metals, transition metals of the Group IIA, IVB, VB, VIIB, VIII, IB, IIB, IIA and IVA periodic groups.

In suitable embodiments, the rheology modifier comprises 0.0001% by weight to about 50% by weight, or 0.001% by weight to about 10% by weight, or alternatively 0.01% by weight to about 5% by weight of the inventive composition.

Solvent

A solvent may optionally be included in the compositions of the present invention to assist in removing dirt, grease, and other unwanted impurities from the surface to be treated. The particular solvent employed in the inventive composition may be selected depending on the particular end use application, and particularly on the type of surface to be treated. In addition, the solvent may serve to help solubilize non-water soluble or poorly water soluble adjuvants, such as ultraviolet light (UV) absorbers, fragrances, perfumes and the like, for the purpose of preventing separation of these ingredients in the inventive compositions. Suitable solvents include both hydrophilic and hydrophobic compounds, generally comprising solvents that are water soluble, water-miscible as well as water insoluble and water-immiscible compounds. Mixtures of any solvent may optionally be employed in the inventive compositions.

Suitable organic solvents include, but are not limited to monohydric alcohols and polyhydric alcohols, such as for example $C_{1-6}$ alkanols and $C_{1-6}$ diols, alkylene glycols, such as for example $C_{1-10}$ alkyl ethers of alkylene glycols, glycol ethers, such as for example $C_{3-24}$ alkylene glycol ethers, polyalkylene glycols, short chain carboxylic acids, short chain esters, isoparaffinic hydrocarbons, mineral spirits, alkylaromatics, terpenes, terpene derivatives, terpenoids, terpenoid derivatives, formaldehyde, and pyrrolidones. Alkanols include, but are not limited to the monohydric alcohols including for example methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to; ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparaffinic hydrocarbons, mineral spirits, alkylaromatics, terpenoids, terpenoid derivatives, terpenes, and terpenes derivatives can be mixed with a water soluble solvent when employed.

Examples of organic solvent having a vapor pressure less than 0.1 mm Hg (20° C.) include, but are not limited to, dipropylene glycol n-propyl ether, dipropylene glycol t-butyl ether, dipropylene glycol n-butyl ether, tripropylene glycol methyl ether, tripropylene glycol n-butyl ether, diethylene glycol propyl ether, diethylene glycol butyl ether, dipropylene glycol methyl ether acetate, diethylene glycol ethyl ether acetate, and diethylene glycol butyl ether acetate (all-available from ARCO Chemical Company).

The solvents, when employed, are optionally present at a level of from 0.001% to 10%, alternatively from 0.01% to 10%, or alternatively from 1% to 4% by weight.

Alkalinity Source

The inventive composition may include an alkalinity source which is believed to increase the effectiveness of the surfactant and overall cleaning efficiency of the compositions. The alkalinity source may be a builder, a buffer and/or a pH adjusting agent which can also function as a water softener and/or a sequestering agent in the inventive composition. The builder, buffer and pH adjusting agents may be used alone, or in mixtures, or in combination with or in the form of their appropriate conjugate acids and/or conjugate bases, for adjusting and controlling the pH of the inventive compositions.

A variety of builders or buffers can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives. Builders or buffers can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builders or buffers can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylaamine, butylamine, butylenediaamine, propylamine, triethylamine, trimethylamine, monoethanolaamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolaamine, diethanolamine, dipropanolanine, triethanolamine, and 2-amino-2methylpropanol. Suitable buffering agents for compositions of this invention are nitrogen-containing materials. Some examples are amino acids such as lysine or lower alcohol amines like monoalkanolamine, dialkanolamine and trialkanolamine. Examples of suitable alkanolamines include the mono-, di-, and tri-ethanolamines. Other suitable nitrogen-containing buffering agents are tri(hydroxymethyl)amino methane (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Other suitable buffers include ammonium carbamate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see WO 95/07971, which is incorporated herein by reference. Other suitable pH adjusting agents include sodium or potassium hydroxide.

When employed, the alkalinity source, builder, buffer, or pH adjusting agent comprises at least about 0.001% and typically about 0.01% to 5% of the inventive composition. Alternatively, the builder, buffer or pH adjusting agent content is about 0.01% to 2%.

Adjuncts

The inventive composition may contain additional optional adjuncts, such as one or more cleaning agents, cleaning aids, protective agents, chelators, builders, cosolvents, cosurfactants, descalers, foam boosters, foam suppressants, surface modification agents, pH adjustors, pH buffers, wetting agents, stain and soil repellants, waxes, resins, polishes, abrasives, colloid stabilizers, silicones, lubricants, odor control agents, perfumes, fragrances and fragrance release agents, brighteners, fluorescent whitening agents, ultraviolet light (UV) absorbers, UV scatterers, excited state quenchers, anti-oxidants, oxygen quenchers, bleaching agents, electrolytes, dyes and/or colorants, phase stabilizers, emulsifiers, thickeners, defoamers, hydrotropes, cloud point modifiers, antimicrobial agents, preservatives, and mixtures thereof.

These optional one or more adjuncts may be employed in embodiments of the inventive compositions to provide further cleaning and protective benefits or functionality to the inventive compositions.

When employed, these one or more optional adjuncts may individually comprise 0.0001% by weight to about 10% by weight, or 0.001% by weight to about 5% by weight, or alternatively 0.01% by weight to about 1% by weight of the inventive composition.

Method of Use

The compositions of the present invention are generally employed to treat and clean the exterior surfaces of vehicles, including for example, but not limited to automobiles, trucks, aeroplanes, motorcycles, boats, marine vehicles, trailers, recreational vehicles, jet skis, snowmobiles, bicycles, tractors and scooters. The compositions of the present invention are suitably used to treat and clean a variety of surface materials, that is materials of construction, including but not limited to metal, painted surfaces, clear coat surfaces, plastic, fiberglass, rubber, vinyl, wood, aluminum, anodized aluminum, stainless steel, elastomer, glass, chrome, tires, wheels, wheel covers, tarpaulins, vehicular covers, windshields and combinations thereof.

In one embodiment, compositions of the present invention may be applied directly onto a soiled exterior surface or soiled material surface. Alternatively, in other embodiment, compositions of the present invention may be applied onto an applicator, including for example, but not limited to, a sponge, wipe, towel, towelette, squeegee, absorbent cloth, foam, shami, or similar carrier or tool employing a combination thereof. In both methods of use, the Vertical Cling parameter of the inventive compositions is sufficient to substantially retain the applied compositions at the desired location. In embodiments in which the compositions of the present invention are first applied to an applicator and then applied to the soiled exterior surface or soiled material surface, the Vertical Cling parameter of the applied inventive compositions is sufficient to substantially retain the applied compositions at the desired location. In another embodiment, the soiled surface is rinsed with water to remove displaceable. soil and dirt, followed by application of the inventive compositions to the wetted surface, where said inventive compositions exhibit a Vertical Cling parameter sufficient to substantially retain the applied compositions on said wetted vertical surface.

Application Means

Compositions of the present invention may be applied to the target surface by a variety of means, including direct application by means of a squeeze, spray, pump or pressurized delivery means, including for example an aerosol dispensing means. Application means known in the art are generally acceptable for dispensing the inventive compositions having a Vertical Cling parameter of between 1 and about 7.

Squeeze Dispensing

Compositions of the present invention are suitably dispensed by means of a squeeze dispensing package, which are common in the art and used for dispensing cleaning materials such as liquid soaps. Such squeeze dispensing packages enable direct application of the inventive compositions onto the soiled surfaces requiring treatment. Suitable squeeze dispensing packages generally include a dispensing closure in combination with a flexible and/or deformable container which stores and holds the invention compositions, and dispenses contents through a dispensing orifice when the container is substantially inverted and squeezed. Acceptable containers include semi-rigid flexible containers that are generally employed to hold larger volumes of liquid and are therefore appropriate for multiple dispensing uses. Also, acceptable are pouches and more flexible containers that are generally employed to hold smaller liquid volumes and are therefore appropriate for single use or a small number of multiple dispensing uses. In general, any type of container may be employed for squeeze dispensing applications provided that the container can deform in some aspect upon applied pressure, generally applied hand pressure, in order to act on the liquid contents to effect dispensing. Rigid and less flexible containers may also be suitably employed if other means of pressurizing or inducing flow of the container contents can be achieved. The containers may be constructed of any suitable material exhibiting the desired properties of flexibility and/or rigidity. Examples of acceptable construction materials include polyethylene, polybutylene, polycarbonate, polyethylene terephthalate, acrylonitrile butyl styrene, polystyrene, polyvinyl chloride, post consumer recycled resin and mixtures thereof. Post consumer recycled resin (PCR) refers to mixed resins of the above types that have been combined from plastic recycling processes into mixtures of generally uncertain composition but generally exhibiting well defined handling and physical properties, such as melting point, ductility, color and low impurity levels, so as to be acceptable for use in new consumer articles. Generally, when post consumer recycled resin is employed, it is mixed with virgin, that is non-recycled polymers and/or resins, such that the finished material of construction has a compositional minority of post consumer recycled resin, and generally a composition wherein the PCR content is less than about 30%.

Typical dispensing closures serve to both seal the contents of the container and are reversibly openable/closeable in order to dispense liquid contents upon demand. Such dispensing closures are well known in the art and include, but are not limited to push/pull fitments, flip tops, snap caps, screw caps, nozzles, and the like. There is no limitation in selection of the dispensing closure for use with the present invention, other than having a dispensing orifice of appropriate size (that is of sufficient internal diameter) so as to allow dispensing and flow of the inventive compositions upon demand. In general, an orifice size from about 1 to 10 mm in internal diameter is sufficient, although other sizes or multiple orifices of smaller size can also be suitably employed. In an embodiment of the present invention, a dispensing closure employing a self-closing flexible or elastomeric element is suitable for use. The self-closing dispensing closures provide for easy dispensing of the inventive compositions upon demand, yet stop the flow of material from the container instantly when applied pressure is removed. Suitable self-closing or self-sealing closures are described in U.S. Pat. No. 6,079,594 to Brown et al., U.S. Pat. No. 5,996,845 to Chan, U.S. Pat. No. 6,732,889 to Oren, et al., U.S. Pat. No. 3,884,396 to Gordon et al., U.S. Pat. No. 5,499,736 to Kohl, U.S. Pat. No. 6,230,940 to Manning, et al., U.S. Pat. No. 672,487 to Lohman, U.S. Pat. No. 6,705,492 to Lowry, U.S. Pat. No. 5,918,777 to Flak, U.S. Pat. No. 6,112,951 to Mueller, and U.S. Pat. No. 6,325,253 to Robinson; all of said references being incorporated herein by reference. Also suitable are nozzles made from elastomeric, i.e. deformably recoverable, materials including, but not limited to polymeric materials such as rubber, silicone, silicone rubber, fluorosilicone, acrylic silicone and the like. Some examples of rubber polymers suitable for use include natural and synthetic rubbers, particularly those common to the art such as polyisoprene or natural rubber, polybutadiene, polyisobutylene, and the polyurethanes. The polymers used in silicone and silicone rubber elastomers are of the general structure $(R_1R_2R_3)SiO—[R_3R_4SiO]_x[R_3R_4SiO]_y—SiO—(R_1R_2R_3)$, where $R_1$, $R_2$, $R_3$, $R_4$ each independently represents an —OH, $—CH{=}CH_2$, $—CH_3$, or another alkyl or aryl group, and the degree of polymerization (DP) is the sum of subscripts x and y. For high consistency silicone rubber elastomers, the DP is typically in the range of 5000 to 10,000. Thus, the molecular weight of the polymers, also known in the art as silicone gums, used in the manufacture of high consistency silicone rubber elastomers ranges from 350,000 to 5,000,000 or greater. The polymer systems used in the formulation of these elastomers can be either a single polymer species or a blend of polymers containing different functionalities or molecular weights. The polymers are selected to impart specific performance attributes to the resultant elastomer products. Many manufacturers use reinforcing fillers to add strength to the finished elastomer product. Typically, these fillers are amorphous fumed silicas, although the use of precipitated silicas has increased in recent years. Particle sizes of standard reinforcing fillers normally fall within the range of 5 to 20 nm in diameter. Silicone elastomers with and without fillers are suitable for material of construction for the elastomeric nozzles employed in one embodiment of the nozzle dispensing means of the present invention.

Spray Dispensing

Compositions of the present invention may be also be sprayed directly onto the target surface and therefore may be packaged in a spray dispenser. The spray dispenser can be any of the manually activated means for producing a spray of liquid droplets as is known in the art, e.g. trigger-type, pump-type, electrical spray, hydraulic nozzle, sonic nebulizer, high pressure fog nozzle, non-aerosol self-pressurized, and aerosol-type spray means. Automatic activated means can also be used herein. These type of automatic means are similar to manually activated means with the exception that the propellant is replaced by a compressor.

The spray dispenser can be an aerosol dispenser. The aerosol dispenser comprises a container which can be constructed of any of the conventional materials employed in fabricating aerosol containers. The dispenser must be capable of withstanding internal pressure in the range of from about 5 to about 120 p.s.i.g. or alternatively from about 10 to about 100 p.s.i.g. The one important requirement concerning the dispenser is that it be provided with a valve member which will permit the inventive compositions contained in the dispenser to be dispensed in the form of a continuous stream or continuous spray of droplets. The aerosol dispenser utilizes a pressurized sealed container from which the inventive composition is dispensed through an actuator/valve assembly under pressure. The aerosol dispenser is pressurized by incorporating therein a gaseous component generally known as a propellant. A more complete description of commercially available aerosol-spray dispensers appears in U.S. Pat. No. 3,436,772, Stebbins; and U.S. Pat. No. 3,600,325, Kaufman et al.; both of said references are incorporated herein by reference.

Alternatively in one embodiment, the spray dispenser can be a self-pressurized non-aerosol container having a convoluted liner and an elastomeric sleeve. Said self-pressurized dispenser comprises a liner/sleeve assembly containing a thin, flexible radially expandable convoluted plastic liner of from about 0.010 to about 0.020 inch thick, inside an essentially cylindrical elastomeric sleeve. The liner/sleeve is capable of holding a substantial quantity of odor-absorbing fluid product and of causing said product to be dispensed. A more complete description of self-pressurized spray dispensers can be found in U.S. Pat. No. 5,111,971, Winer, and U.S. Pat. No. 5,232,126, Winer; both of said references are herein incorporated by reference.

Another type of aerosol spray dispenser is one wherein a barrier separates the invention composition from the propellant (usually compressed air or nitrogen), as is disclosed in U.S. Pat. No. 4,260,110, incorporated herein by reference. Such a dispenser is available from EP Spray Systems, East Hanover, N.J.

In another embodiment of the present invention, the spray dispenser is a non-aerosol, manually activated, pump-spray dispenser. Said pump-spray dispenser comprises a container and a pump mechanism which securely screws or snaps onto the container. The container comprises a vessel for containing the inventive composition to be dispensed. The pump mechanism comprises a pump chamber of substantially fixed volume, having an opening at the inner end thereof. Within the pump chamber is located a pump stem having a piston on the end thereof disposed for reciprocal motion in the pump chamber. The pump stem has a passageway there through with a dispensing outlet at the outer end of the passageway and an axial inlet port located inwardly thereof.

The container and the pump mechanism can be constructed of any conventional material employed in fabricating pump-spray dispensers, including, but not limited to: polyethylene; polypropylene; polyethyleneterephthalate; blends of polyethylene, vinyl acetate, and rubber elastomer. Other materials can include stainless steel. A more complete disclosure of commercially available dispensing devices appears in: U.S. Pat. No. 4,895,279, Schultz; U.S. Pat. No. 4,735,347, Schultz et al.; and U.S. Pat. No. 4,274,560, Carter; all of said references are herein incorporated by reference.

In yet another embodiment, the spray dispenser is a manually activated trigger-spray dispenser. Said trigger-spray dispenser comprises a container and a trigger both of which can be constructed of any of the conventional material employed in fabricating trigger-spray dispensers, including, but not limited to: polyethylene; polypropylene; polyacetal; polycarbonate; polyethyleneterephthalate; polyvinyl chloride; polystyrene; blends of polyethylene, vinyl acetate, and rubber elastomer. Other materials can include stainless steel and glass. The trigger-spray dispenser does not incorporate a propellant gas. The trigger-spray dispenser herein is typically one which acts upon a discrete amount of the inventive composition itself, typically by means of a piston or a collapsing bellows that displaces the composition through a nozzle to create a stream or spray of liquid. Said trigger-spray dispenser typically comprises a pump chamber having either a piston or bellows which is movable through a limited stroke response to the trigger for varying the volume of said pump chamber. This pump chamber or bellows chamber collects and holds the product for dispensing. The trigger spray dispenser typically has an outlet check valve for blocking communication and flow of fluid through the nozzle and is responsive to the pressure inside the chamber. For the piston type trigger sprayers, as the trigger is compressed, it acts on the fluid in the chamber and the spring, increasing the pressure on the fluid. For the bellows spray dispenser, as the bellows is compressed, the pressure increases on the fluid. The increase in fluid pressure in either trigger spray dispenser acts to open the top outlet check valve. The top valve allows the product to be forced through the swirl chamber and out the nozzle to form a discharge stream or pattern. An adjustable nozzle cap can be used to vary the pattern of the fluid dispensed. For the piston spray dispenser, as the trigger is released, the spring acts on the piston to return it to its original position. For the bellows spray dispenser, the bellows acts as the spring to return to its original position. This action causes a vacuum in the chamber. The responding fluid acts to close the outlet valve while opening the inlet valve drawing product up to the chamber from the reservoir.

A more complete disclosure of commercially available dispensing devices appears in U.S. Pat. No. 4,082,223, Nozawa; U.S. Pat. No. 4,161,288, McKinney; U.S. Pat. No. 4,434,917, Saito et al.; U.S. Pat. No. 4,819,835, Tasaki; and U.S. Pat. No. 5,303,867, Peterson; all of said references are incorporated herein by reference. A broad array of trigger sprayers or finger pump sprayers are suitable for use with the compositions of this invention. These are readily available from suppliers such as Calmar, Inc., City of Industry, Calif.; CSI (Continental Sprayers, Inc.), St. Peters, Mo.; Berry Plastics Corp., Evansville, Ind.; or Seaquest Dispensing, Cary, Ill.

In general, the spray dispensers are most suitably employed with inventive compositions that also display some degree of shear thinning character in addition to the Vertical Cling rheological characteristics of the present invention. Alternatively, the orifice size of the spray dispenser passageways, chambers, inlet and outlet orifices can be sized appropriately, which is to say generally enlarged in internal diameter with respect to sizes appropriate for thin liquids like water, to an extent governed by the viscosity of the inventive compositions to provide suitable dispensing characteristics.

Cleaning Kit

Combinations of the inventive compositions with a container having suitable dispensing means, methods of use and instructions for use of the concentrated cleaning compositions for cleaning soiled vehicular surfaces are conveniently combined in the cleaning kit. In one embodiment of the cleaning kit, the concentrated cleaning compositions are packaged in a squeezable package bearing a self-sealing elastomeric valve dispensing orifice and overcap that stores and dispenses the concentrated cleaner on demand and bears instructions for direct application of the inventive compositions onto either the soiled vehicular surface or onto an applicator for subsequent delivery to the soiled vehicular surface. In another embodiment of the cleaning kit, the inventive compositions are packaged in an aerosol container with contents including an environmentally friendly propellant and bearing instructions for use, wherein said instructions include the steps of directly applying the concentrated cleaning compositions to the intended target surface.

In yet another embodiment of the cleaning kit, the instructions direct for rinsing the soiled surface with water prior to application of the concentrated cleaning compositions of the present invention. In a further embodiment of the cleaning kit, a clear or translucent packaging material is employed to mold the container holding the inventive compositions so that the level of remaining material in the container subsequent to dispensing and application can be easily viewed. In this embodiment, the contents of the container can be manipulated, such as for example by shaking or inverting, such that the contents are positioned near the dispensing orifice of the cleaning kit for ease in application of the liquid material, particularly as the contents of the container are used up. In yet another embodiment, a flexible dispensing package is employed that displaces the inventive compositions without the re-introduction of air into the package so that the cleaning composition remains in readiness within the immediate vicinity of the dispensing orifice so that the cleaning composition is released simultaneously with applied pressure despite the decreasing level of the inventive composition within the package with continued and/or repeated dispensing over time.

In yet another embodiment of the cleaning kit, the inventive compositions, instructions for use and dispensing means are combined in a single or multiple use disposable flexible container with a dispensing orifice which contains sufficient cleaning concentrate so as to be sufficient for treatment of at least one or more vehicular surfaces.

RESULTS AND DISCUSSION

Vertical Cling Parameter

The Vertical Cling parameter of a liquid material is determined in the following manner, using a test panel of a representative material selected for convenience of testing under controlled conditions. The representative material is a clear coated black painted metal test panel obtained from ACT Laboratories Co., Hillsdale, Mich., designated Ford F-Series APR437222. A rectangular test panel with an approximate size of about 18 inches in width and about 12 inches in height is divided into six vertical sections of equal dimensions so as to provide for six roughly equivalently sized sections of about 3 inch width by 12 inch length. Division of the six vertical sections may be done by use of a marking pen, tape or any such similar means that provides visual separation of the sections solely for ease in conducting the test. The six sections provide for test replicates. During testing, the test panel is positioned upright such that its shortest dimension is perpendicular to a flat horizontal support surface and the longest dimension is parallel to said horizontal, thus positioning the test panel in a generally vertical (upright) plane. The test panel is locked into position upright using a clamp or frame which holds in at angle of approximately 95° with respect to said horizontal, that is about 5° from normal to the vertical plane, oriented such that the test surface (front surface) is inclined backwards by 5° from a position normal to the plane. This position allows applied liquid material to contact the slightly declined front surface of the test panel, and under the influence of gravity to flow downward and along the front surface of the test panel for purposes of testing the Vertical Cling parameter of the liquid material.

Liquid material is prepared for application by placing approximately 3 milliliters of the liquid material in an appropriately sized syringe (5 or 10 milliliter volume) that is partially filled with 3 milliliters of the liquid material with air displaced so that the liquid material is positioned between the syringe orifice and plunger with no intervening air gap or trapped air bubbles present. Multiple syringes may be prepared or the same syringe used for replicates of the same liquid material. At the start of testing, the filled syringe with liquid material is held at the top of one of the six sections, at a position approximately 1 inch below the top and positioned so that the syringe orifice is approximately 2 inches from the surface of the test panel. Simultaneously, a) the syringe is manually depressed to dispense the liquid material onto the top of the test panel in one smooth motion to completely dispense all liquid; and b) a timer starting at zero time is initiated to provide elapsed time in seconds. After exactly 120 seconds (two minutes) has elapsed, a ruler with rulings indicating to at least 0.0125 inches is employed to measure the total length of the liquid material path (flow length), starting at the highest position where liquid material wet the test surface at the point of application and ending at the lowest position wetted by the flowing liquid material on the test surface. The flow length is recorded to the nearest 0.0125 inches. Additional replicates of the test are repeated following the same procedure using an aliquot of the liquid material in each succeeding section of the test panel to produce at least six individual flow length values. The average value of the six individual flow length replicate values represents the Vertical Cling parameter (in units of inches flow per 2 minutes) of the liquid material on the test surface.

It is noted that selected test materials, including liquid materials and test panels of the selected surface material are tested at about 25° C. Higher or lower temperatures can result in either increased or decreased flow rates owing to temperature sensitivity generally known in the art to be associated with the temperature-dependent rheological behavior of liquids. Thus, all testing is conducted using temperature equilibrated test materials and ambient temperatures of about 25° C. It was also noted that rinsing or pre-wetting of the test panel surfaces with water did not significantly effect measured values of the Vertical Cling parameter of the inventive compositions. Without being bound by theory, it is believed that the typical surfaces of interest and materials of construction of vehicular exterior surfaces are substantially, non-absorbing and do not retain water to any significant extent, and particularly so on partially inclined or vertically oriented surfaces. Thus, for purposes of determining the Vertical Cling parameter, rinsing of the test panel or test materials is optional.

The Vertical Cling parameter thus represents a convenient and easy to measure parameter that describes the overall rheological behavior of the inventive compositions, which are characterized by their ability to cling to a vertical surface without running, dripping or flowing excessively, as defined by a Vertical Cling parameter value of between 1 to about 7. The inventive compositions have sufficient vertical clinging characteristics to exhibit a Vertical Cling parameter of at least 1. Compositions that are generally too viscous and also exhibit no measurable flow under conditions of the Vertical cling test, that is to say exhibit a Vertical Cling parameter less than 1 or essentially zero, lack utility in that they are generally too viscous for ease of dispensing and for ease of application and spreading across a treated surface. Conversely, compositions that are generally less viscous and also exhibit a Vertical Cling parameter of greater than 7, are found to have insufficient cling to vertical surfaces. Inventive compositions exhibiting a Vertical Cling parameter of between 1 to about 7 generally tend to also exhibit ease of application with no excessive running or dripping from the desired application area enabling a minimum amount of the cleaning composition to be employed where needed. While the measured viscosity of the inventive compositions and the Vertical Cling parameter are not necessarily proportional, it is generally found that inventive compositions include those compositions having measured viscosities between about 2000 centipoise (cps) to about 20,000 cps while simultaneously exhibiting a Vertical Cling parameter of between 1 and about 7.

EXAMPLES

Examples of suitable embodiments of the inventive compositions are provided in Table 1. Comparison of an exemplified inventive composition (Ex. 1) with some known commercial products was performed and results are presented in Table 2. Compositions of the present invention were tested versus two commercially available products commonly employed to wash vehicles. Although both commercial products bore instructions to dilute into water before use, these products were tested for their suitability for direct application to a vehicular surface following the Vertical Cling test procedure described herein. Both commercial products flowed excessively with Vertical Cling parameters well above 7.

Viscosity measurements were also conducted with results of the commercial products and exemplary inventive composition presented in Table 2. Surprisingly, it was found that the viscosity of the liquid materials as tested did not directly correlate with the measured Vertical Cling parameter. That is to say, the more viscous commercial product did not necessarily exhibit the slowest flow rate nor exhibit a desirable Vertical Cling parameter. Without being bound by theory, it is believed that rheological contribution to the Vertical Cling characteristics of the inventive compositions include other factors, such as for example surface wetting, friction and shear flow behavior, that are not readily represented by a measured viscosity value alone. Thus, the Vertical Cling parameter represents the best measure of the inventive compositions and best describes the concentrated cleaning compositions suitable for the methods of use, methods of application, and cleaning kit as presented herein.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

TABLE 1

| Ingredient | Ex. 1 | Ex. 2 | Ex. 3 | Ex. 4 | Ex. 5 | Ex. 6 |
|---|---|---|---|---|---|---|
| Carbopol EZ3 (1) | 0.95 | 0.95 | 0.95 | 0.95 | 2 | 3 |
| Dowanol PnB (2) | 3 | 2 | 1 | — | — | — |
| Biosoft S-101 (3) | 2.5 | 1.2 | — | 3.9 | — | 4.1 |
| Bioterge AS-40 (4) | 1.2 | 2.5 | 3.7 | — | 3.9 | — |
| Ninol 40-CO (5) | 0.4 | 0.4 | 0.4 | 0.2 | 0.2 | — |
| Fragrance | 0.0125 | 0.0125 | 0.0125 | 0.0125 | — | 0.0125 |
| Dye | 0.01 | 0.01 | 0.01 | 0.01 | 0.01 | 0.01 |
| Dantoguard Plus (6) | 0.1 | 0.1 | 0.1 | 0.1 | 0.1 | 0.1 |
| NaOH (7) | 0.68 | 0.68 | 0.68 | 0.68 | 1.4 | 2.1 |
| Water (8) | q.s. | q.s. | q.s. | q.s. | q.s. | q.s. |
| Total | 100 | 100 | 100 | 100 | 100 | 100 |

(1) Crosslinked polyacrylic polymer from Noveon, Inc.
(2) Glycol ether solvent from Dow Chemical Co.
(3) Linear alkylbenzene sulfonic acid from Stepan Co.
(4) Sodium alkyl olefin sulfonate from Stepan Co.
(5) Cocoamide diethanolamine from Stepan Co.
(6) Preservative from Lonza, Inc.
(7) Alkalinity source, pH adjusted to about 7.
(8) Quantity sufficient deionized water to 100 wt %. All compositions are on active basis.

TABLE 2

| Liquid Material | Viscosity (1) cps | Vertical Cling (2) |
|---|---|---|
| Reference Product 1 (3) | 3719 | n/d, >11 (4) |
| Reference Product 2 (5) | 1264 | 8.25 |
| Inventive Example 1 | 7778 | 6.25 |

(1) Viscosity measured in centipoise (cps) at 25° C. using an LV Viscometer equipped with spindle #4 operating at 30 rpm.
(2) Vertical Cling parameter determined using clear coated black painted metal test panel obtained from ACT Laboratories Co., designated Ford F-Series APR437222.
(3) Meguiar's Soft Wash Gel ™, commercially available product from Meguiar's Company, Irvine, California (2004).
(4) Not determinable. Flow length exceeded test panel length (11 inches) after 20 seconds.
(5) Rain X ™ Foaming Wash & Wax ™, commercially available product from SOPUS Products, Houston, Texas (2004).

We claim:

1. A vehicular cleaning concentrate comprising:

(a) a surfactant;

(b) about 0.01 to 10% by weight of an organic solvent;

(c) optionally, an alkalinity source;

(d) a rheology modifier selected from the group consisting of: organic polymers, natural polymers and mixtures thereof; and (e) about 91 to 94% by weight of water;

wherein the cleaning concentrate has a viscosity of between about 2,000 cps to about 20,000 cps and exhibits a Vertical Cling parameter of between 1 and about 7 at a temperature of about 25° C.

2. The cleaning concentrate of claim 1, wherein said cleaning concentrate exhibits a Vertical Cling parameter of between 1 and about 6 at a temperature of about 25° C.

3. The cleaning concentrate of claim 1, wherein said surfactant is selected from the group consisting of anionic surfactants, nonionic surfactants and mixtures thereof.

4. The cleaning concentrate of claim 1, wherein said organic solvent is selected from the group consisting of a monohydric alcohol, polyhydric alcohol, alkylene glycol, glycol ether, and mixtures thereof.

5. The cleaning concentrate of claim 1, wherein said rheology modifier is selected from the group consisting of organic polymers, natural polymers, inorganic thickeners and mixtures thereof hydrophobic polymers, hydrophobically-modified polymers, polymers exhibiting both properties owing to the presence of hydrophilic and hydrophobic monomer moieties, and mixtures thereof.

6. The cleaning concentrate of claim 1, wherein said rheology modifier is selected from the group consisting of acrylic polymers, methacrylic polymers, acrylamide polymers, acrylic and acrylamide copolymers, methacrylic and acrylamide copolymers and mixtures thereof.

7. The cleaning concentrate of claim 1, wherein said alkalinity source is selected from the group consisting of an alkaline or alkali earth metal hydroxide, sodium carbonate, sodium tripolyphosphate, sodium silicate, ammonium hydroxide, alkanolamine, dialkanolamine, trialkanolamine and mixtures thereof.

8. A method for cleaning a soiled surface comprising the steps of:

(a) applying to the soiled surface a cleaning concentrate having a Vertical Cling parameter of between 1 and about 7 at a temperature of about 25° C. and having a viscosity of between about 2,000 cps to about 20,000 cps comprising:
  (i) a surfactant;
  (ii) about 0.01 to 10% by weight of an organic solvent;
  (iii) optionally, an alkalinity source;
  (iv) a rheology modifier selected from the group consisting of: organic polymers, natural polymers and mixtures thereof; and
  (v) about 91 to 94% water by weight;
(b) spreading the cleaning concentrate across said surface to act on soil; and
(c) rinsing said surface with water to remove said cleaning concentrate and soil.

9. The method of claim 8, wherein said soiled surface is an exterior surface selected from the group consisting of automobiles, trucks, aeroplanes, motorcycles, boats, marine vehicles, trailers, recreational vehicles, jet skis, snowmobiles, bicycles, tractors and scooters.

10. The method of claim 9, wherein said soiled surface is a material of construction selected from the group consisting of metal, painted surfaces, clear coat surfaces, plastic, fiberglass, rubber, vinyl, wood, aluminum, anodized aluminum, stainless steel, elastomers, glass, chrome, tires, wheels, wheel covers, tarpaulins, vehicular covers, windshields and combinations thereof.

11. The method of claim 8, wherein said step (a) is performed using manual application of said cleaning concentrate from a package comprising: (i) a deformable container; (ii) a dispensing nozzle; and (iii) a cleaning concentrate.

12. The method of claim 11, wherein said dispensing nozzle comprises a deformable elastomeric nozzle.

13. The method of claim 12, wherein said deformable elastomeric nozzle comprises a silicone elastomer.

14. The method of claim 8, wherein the method further comprises the step of applying an additional cleaning concentrate to the soiled surface following said rinsing step (c).

15. An vehicular cleaning kit comprising:

(a) a cleaning concentrate comprising:
  (i) a surfactant;
  (ii) about 0.01 to 10% by weight of an organic solvent;
  (iii) optionally, an alkalinity source;
  (iv) a rheology modifier selected from the group consisting of: hydrophobic polymers, hydrophobically-modified polymers, polymers exhibiting both properties owing to the presence of hydrophilic and hydrophobic monomer moieties, and mixtures thereof, and
  (v) about 91 to 94% by weight of water;

wherein the cleaning concentrate has a viscosity of between about 2,000 cps to about 20,000 cps and exhibits a Vertical Cling parameter of between 1 and about 7 at a temperature of about 25° C.;

(b) a dispensing package; and
(c) instructions for application of said cleaning concentrate wherein said instructions include the step of directly applying said cleaning concentrate to a surface.

16. The cleaning kit of claim 15, wherein said dispensing package comprises:

(a) a deformable container; and
(b) a deformable elastomeric nozzle.

17. The cleaning kit of claim 16, wherein said deformable container comprises a construction material selected from the group consisting of polyethylene, polybutylene, polycarbonate, polyethylene terephthalate, acrylonitrile butyl styrene, polystyrene, polyvinyl chloride, post consumer recycled resin and mixtures thereof.

18. The cleaning kit of claim 17, wherein said construction material is substantially transparent or translucent such that said cleaning concentrate is visible through said construction material.

19. The cleaning kit of claim 15, wherein said cleaning instructions of step (c) include instructions to apply said cleaning concentrate of step (a) to a surface selected from the group consisting of a soiled vehicular surface, a cleaning implement, a sponge, a tool, a cloth, a towel, a shami and combinations thereof.

* * * * *